US005243728A

United States Patent [19]

Smith et al.

[11] Patent Number: 5,243,728

[45] Date of Patent: Sep. 14, 1993

[54] MULTIPLE INDEPENDENT VARIABLE SPEED TRANSFER ROLLERS FOR BOWLING LANE DRESSING APPARATUS

[75] Inventors: Ronald L. Smith, Boulder; Gary D. Fields, Parker, both of Colo.

[73] Assignee: AMF Bowling, Inc., Golden, Colo.

[21] Appl. No.: 974,285

[22] Filed: Nov. 10, 1992

Related U.S. Application Data

[63] Continuation-in-part of Ser. No. 775,841, Oct. 15, 1991, Pat. No. 5,161,277.

[51] Int. Cl.[5] ..... A63D 5/10; A47L 11/282

[52] U.S. Cl. ..... 15/98; 15/103.5; 118/262

[58] Field of Search ..... 15/4, 98, 103.5; 118/262

[56] References Cited

U.S. PATENT DOCUMENTS 4,959,884 10/1990 Ingermann et al. ..... 15/302

5,185,901 2/1993 Davis et al. ..... 15/98

*Primary Examiner*—Edward L. Roberts

*Attorney, Agent, or Firm*—Fields, Lewis, Pittenger & Rost

[57] ABSTRACT

In one embodiment, a bowling lane dressing apparatus has a carriage. With a lane buffer roller and a transfer roller in rolling engagement with the lane buffer roller and in fluid communication with a reservoir containing lane dressing fluid for transferring fluid from the reservoir to the lane buffing roller. A variable speed drive is connected to the transfer roller for rotating it at variable speeds to vary the rate of transfer of fluid from the reservoir to the lane buffer roller. In a second embodiment, the transfer roller is separated into independently rotatable roller segments, each of which can be driven by separate variable speed motors. The segments may comprise a center roller segment driven by one variable speed motor, a pair of track roller segments at opposite ends of the center roller segment, respectively, driven by a second variable speed motor, and a pair of outer roller segments at opposite outer ends of said track roller segments, respectively, driven by a third variable speed motor. In a third embodiment, each roller is driven by a separate variable speed motor.

17 Claims, 7 Drawing Sheets

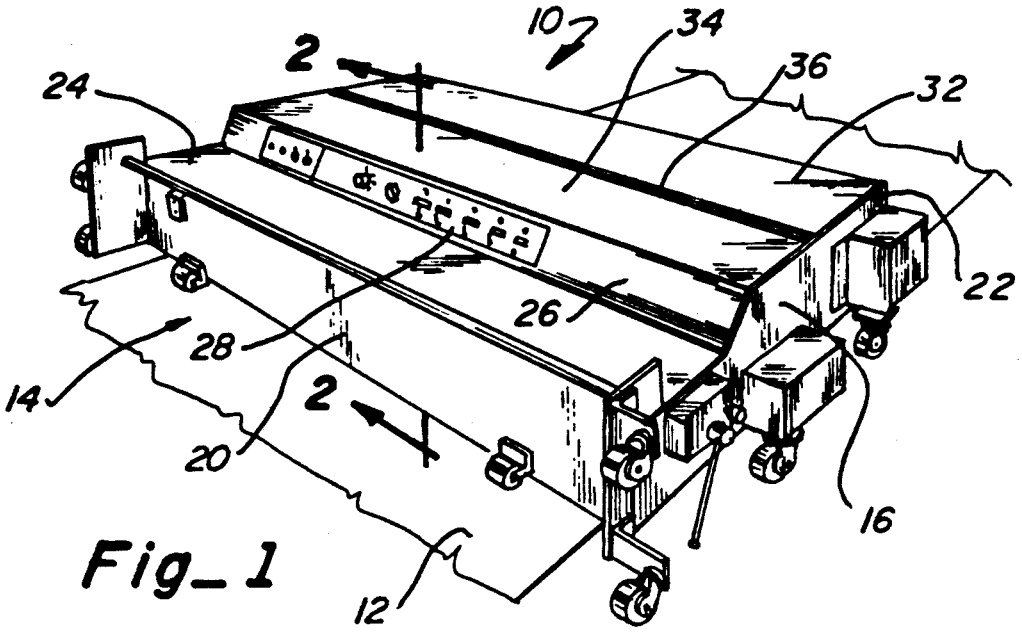
Fig_1
Fig_2
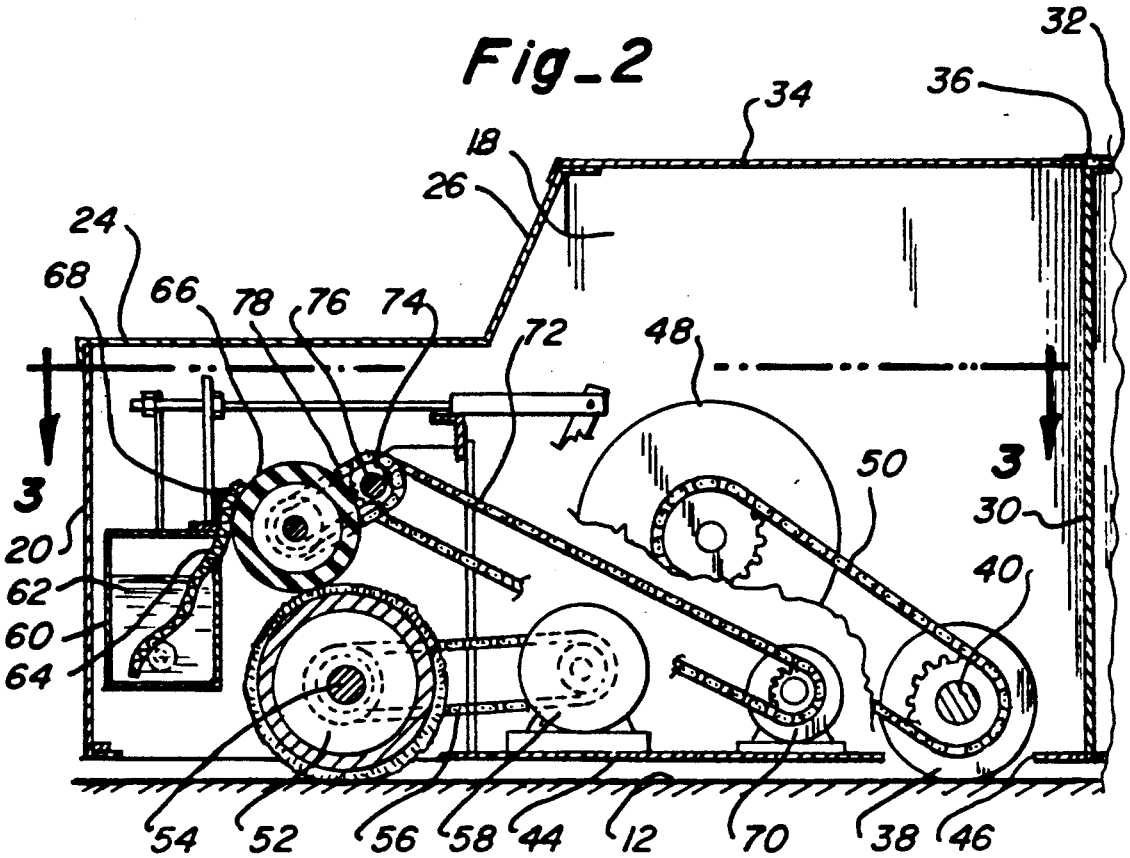

100
101
104
107
109
124
126
128
134
136
137
138
139
140
142
144
146
147
148
149
150
151
152
166
167
168
169
174
176
177
178
179
11
12

MULTIPLE INDEPENDENT VARIABLE SPEED TRANSFER ROLLERS FOR BOWLING LANE DRESSING APPARATUS

TECHNICAL FIELD

This application is a continuation-in-part of Ingermann et al. U.S. patent application Ser. No. 07/775,841 filed Oct. 15, 1991, now U.S. Pat. No. 5,161,277.

This invention relates to a transfer roller mechanism for a bowling lane dressing apparatus and more particularly to one in which the speed of one or more transfer rollers or transfer roller segments can be varied to more precisely control the amount of oil placed on a bowling lane.

BACKGROUND ART

Ingermann et al. U.S. Pat. No. 4,959,884 for "Combination Bowling Lane Stripper and Dressing Apparatus", among other limitations, discloses a transfer device for transferring dressing oil from a reservoir to an applicator roller. This device includes a transfer roller which receives oil from the reservoir by means of a wick and then transfers the oil to an applicator roller. The transfer roller is driven by a chain drive between it and the drive rollers for moving the device down the bowling lane. The device includes pressure fingers which can be adjusted to vary the amount of oil transferred from the reservoir to the transfer roller so that different amounts of oil can be applied to different boards across the width of the bowling lane. However, for any given pressure across the transfer roller, the amount of oil applied from the transfer roller to the buffer roller is strictly a function of the speed of the guide roller and can be varied only by varying the viscosity of the oil in the reservoir. Thus, the degree of control available with that device is limited.

DISCLOSURE OF THE INVENTION

In accordance with this invention, a bowling lane dressing apparatus is provided which has a carriage for movement along the bowling lane between the foul line and the pit. Drive wheels are rotatably mounted on the carriage for moving the carriage along the bowling lane by means of a first drive means connected thereto. A lane buffer roller is journaled on the carriage in lane-contacting relation which extends transversely to the direction of travel. The lane buffing roller is driven by a second drive means. A reservoir is mounted in the carriage for storage of lane-dressing fluid. A transfer roller is mounted in rolling engagement with the lane buffer roller and in fluid communication with the reservoir for transferring fluid from the reservoir to the lane buffer roller. Variable speed drive means is connected to the transfer roller for rotating it at variable speeds to vary the rate of transfer of fluid from the reservoir to the lane buffer roller.

More specifically, the variable speed drive means includes a variable speed motor mounted on the carriage and connected to the transfer roller to rotate the transfer roller at a speed relative to the speed of rotation of the variable speed motor. A variable resistor is connected in series with the variable speed motor for varying the speed thereof.

In a second form of the invention, the transfer roller is separated into independently rotatable roller segments, each of which can be driven by separate variable speed motors. The segments may comprise a center roller segment driven by one variable speed motor, a pair of tack roller segments at opposite ends of the center roller segment, respectively, driven by a second variable speed motor, and a pair of outer roller segments at opposite outer ends of said track roller segments, respectively, driven by a third variable speed motor.

The variable speed motors for the respective track roller segments and outer roller segments may be connected to the roller pairs by means of a jack shaft interconnecting each roller segment in the pair. By this means the number of motor necessary to drive the total number of rollers may be decreased and bilateral symmetry of the application of fluid to the alley obtained.

Each roller segment outwardly adjacent from the previous segment is mounted on a shaft extending from that previous segment. The shaft of the outwardly adjacent roller segment will have a greater diameter than the shaft to the previous segment and will end at a point adjacent to the end point of the previous segments shaft. The centermost roller segment will have its shaft extending outward in both directions an will be journaled to the carriage of the apparatus to form the axis of roller segments. With this configuration, each roller segment will independently rotate about a common axis.

In a third form of the invention, each roller segment is driven by a separate variable speed motor.

From the foregoing, it will be apparent that the application of lane-dressing fluid to a buffer roller will not be limited by the viscosity of the fluid, but rather can be controlled within broad limits by increasing or decreasing the speed of the transfer roller so that when the speed increases more fluid is applied to the buffer roller and when it is turned at a slower speed less fluid is applied to the buffer roller. Furthermore, it will be apparent that the application of lane dressing fluid to the buffer roller may be in different incremental amounts, at desired widths across the outer roller, providing precise control to tailor the profile of the fluid across the lane.

Additional advantages of this invention will become apparent from the description which follows, taken in conjunction with the accompanying drawings.

BRIEF DESCRIPTION OF THE DRAWINGS

FIG. 1 is a perspective view of a bowling lane dressing apparatus constructed in accordance with this invention;

FIG. 2 is an enlarged vertical section, taken along 2—2 of FIG. 1, showing the variable speed motor for operating the transfer roller;

BEST MODE FOR CARRYING OUR THE INVENTION

Figures 3, 4:
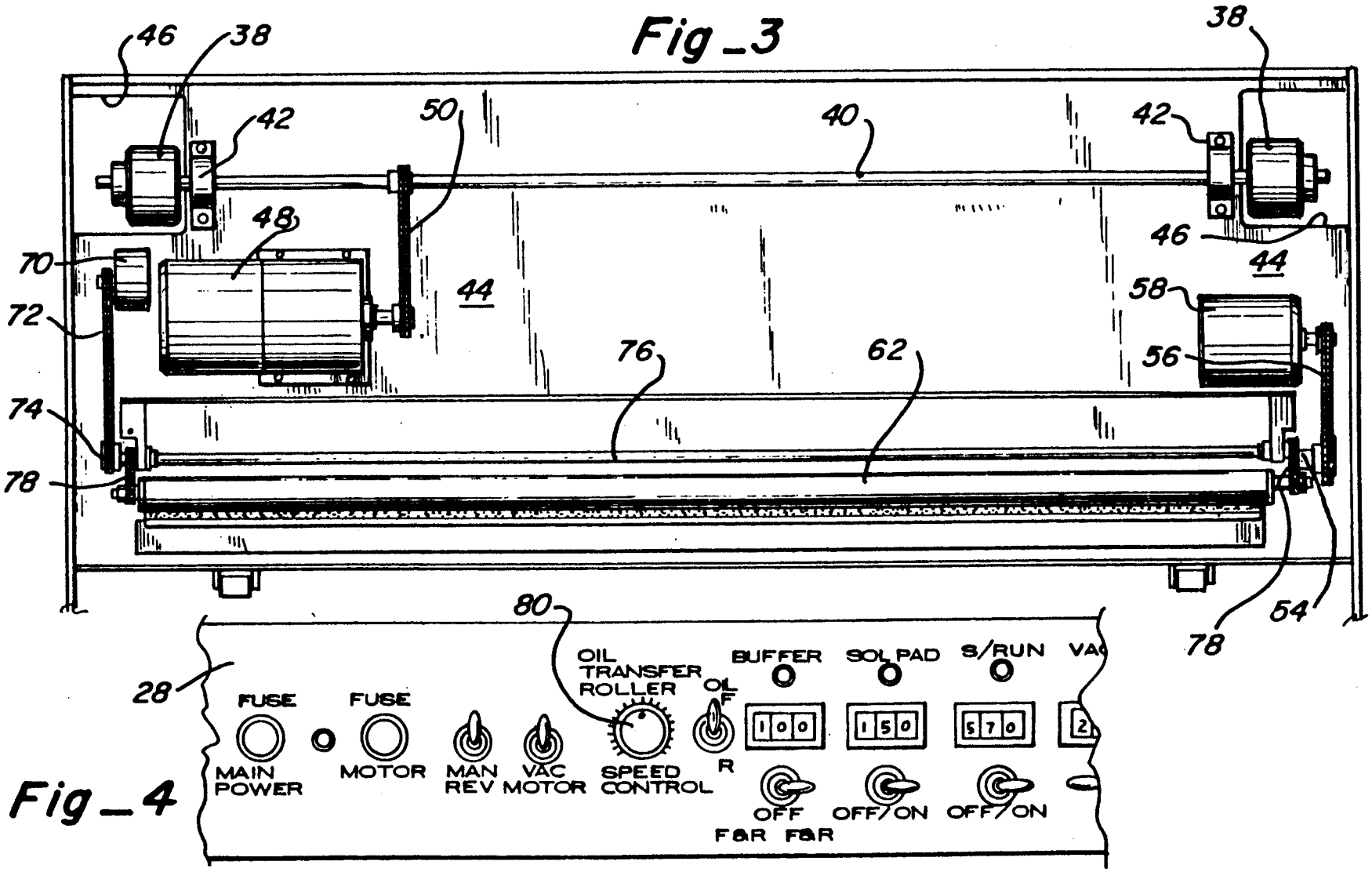
FIG. 3 is a horizontal section, taken along line 3—3 of FIG. 2, showing further details of the apparatus.
FIG. 4 is an enlarged fragmentary view of the control panel for the bowling lane dressing apparatus.
Figure 5:
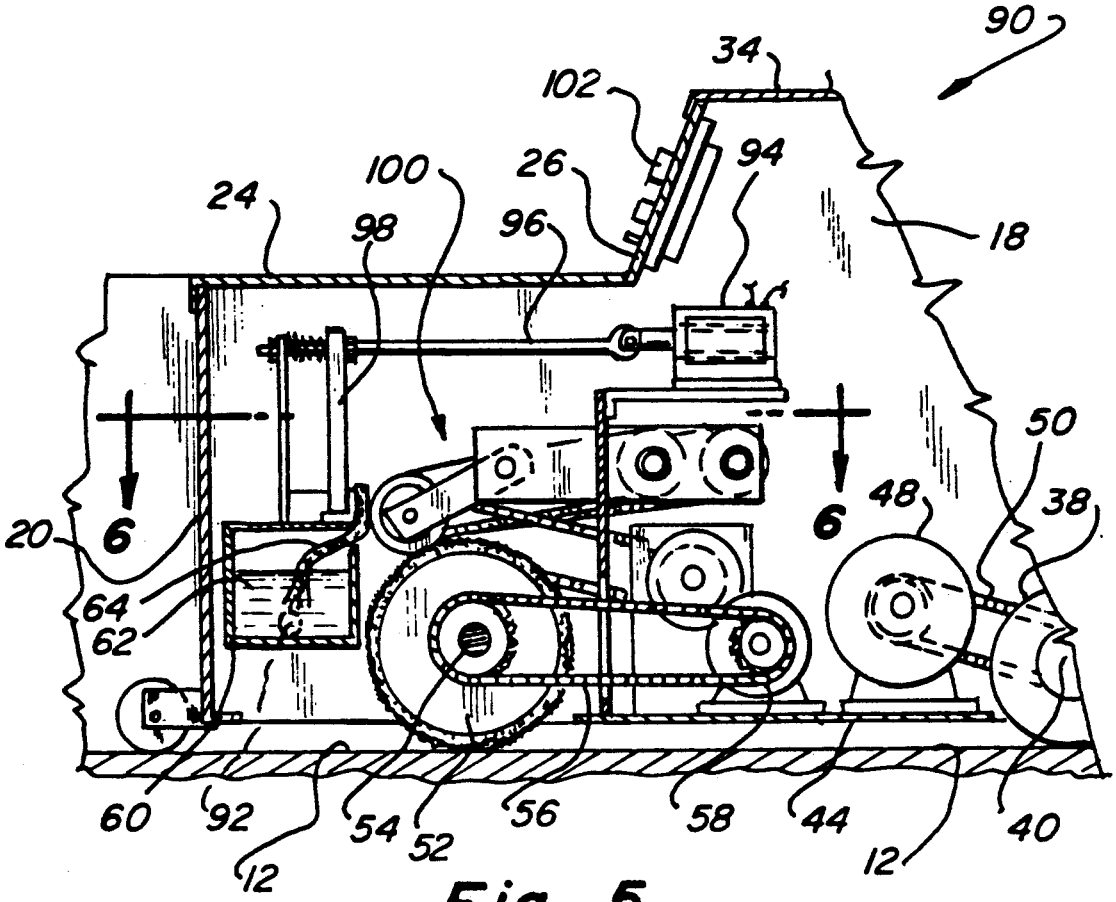
FIG. 5 is an enlarged partial vertical section, taken along line 2—2 of FIG. 1, showing a bowling lane dressing apparatus fitted with a system of independently driven transfer roller segments.

In accordance with the present invention, a dressing apparatus 10 is provided which can be mounted for travel along a bowling lane 12, as shown in FIG. 1. The apparatus has a carriage 14 which houses all of the functional elements of the apparatus. The carriage includes opposite side walls 16 and 18 interconnected by a front wall 20 and a rear wall 22. A top cover 24 extends from the upper edge of front wall 20 and terminates in an upstanding angular wall 26 in which a control panel 28 is mounted for controlling the various functions of the apparatus. A transverse wall 30, shown in FIG. 2, divides a forward portion of the carriage from a rear portion. The device is provided with a top cover having a pivotal section 34 connected to cover 32, as by a piano hinge 36 to provide access to the interior of carriage 14. Details of the mechanics of this device, other than those described below, can be found in Ingermann et al. U.S. Pat. No. 4,959,844 for "Combination Bowling Lane Stripper and Dressing Apparatus" which is incorporated herein by reference.

As best seen in FIGS. 2 and 3, the carriage 14 is provided with spaced drive wheels 38 interconnected by a rotatable shaft 40 journaled adjacent opposite ends in bearings 42. The drive wheels 38 engage the surface of bowling alley 12 for moving the carriage longitudinally along the alley for applying the lane dressing. Conveniently, carriage 14 has a bottom wall 44 having openings 46 therein through which drive wheels 38 extend for contacting the surface of bowling lane 12. A drive shaft 40 interconnects drive rollers 38 and is driven by drive motor 48 through chain drive 50.

The buffer roller 52 is mounted for rotation with central shaft 54 and is positioned to contact bowling alley 12 to apply the bowling lane dressing thereto. Shaft 54 is driven by a drive chain 56 from motor 58 at a constant speed.

A tank or reservoir 60 is mounted adjacent buffer roller 52 within carriage 14 and contains a supply of dressing liquid 62. Conveniently, a wick 64 extends from the liquid to a position in engagement with transfer roller 66 which is in peripheral contact with buffer roller 56. Thus, the dressing liquid 62 will be transferred by wick 64 to transfer roller 66 and by transfer roller 66 to buffer roller 56. One or more pressure fingers 68 can be provided at the top of tank 60 for pressing the upper end of wick 64 against transfer roller 66 to control the rate at which liquid is transferred from wick 64 to transfer roller 66.

In the absence of any additional structure, the transfer roller 66 would be rotated by buffer roller 56 and would turn at a substantially constant rate of speed. However, in accordance with this invention, a variable speed motor 70 is provided. The motor is connected by means of a drive chain 72 to a sprocket 74. This sprocket is connected to the end of a shaft 76 which is interconnected to transfer roller 66 by drive a chain 78 at each end of the transfer roller.

Conveniently, the control panel 28 has a variable speed control 80 which may include a variable resistor in the form of a rheostat and is connected to variable speed motor 38 in a manner well understood by those skilled in the art. Thus, the speed of motor 38 can varied as desired to vary the speed of transfer roller 66. By speeding up the speed of transfer roller 66 more lane dressing fluid can be applied to buffer roller 52 and by slowing down transfer roller 66 less lane dressing fluid is applied to buffer roller 52. This arrangement provides a degree of control of the application of lane dressing fluid to the bowling lane which has not been possible with prior art apparatus. A typical prior art apparatus turns the transfer roller at 50 rpm. With applicant's invention the speed can be varied, such as between 40 rpm and 100 rpm. Other variable speed means may be used.

According to another form of the present invention, dressing apparatus 90 is provided with a transfer system 100 of independent roller segments. Within such a system, a plurality of transfer rollers, or roller pairs, mounted on a common axis and typically of the same outer diameter can be driven by independent variable speed drive means such that each transfer roller or roller pair can be individually controlled to rotate at a specified speed and for a specified distance down the alley. Thereby, a controlled amount of lane dressing fluid may be transferred to a corresponding region of the lane buffer roller and the amount of oil applied to the bowling alley precisely applied. One form of this concept can best be understood with reference to FIGS. 5-13 and the detailed description here following.

Figure 7:
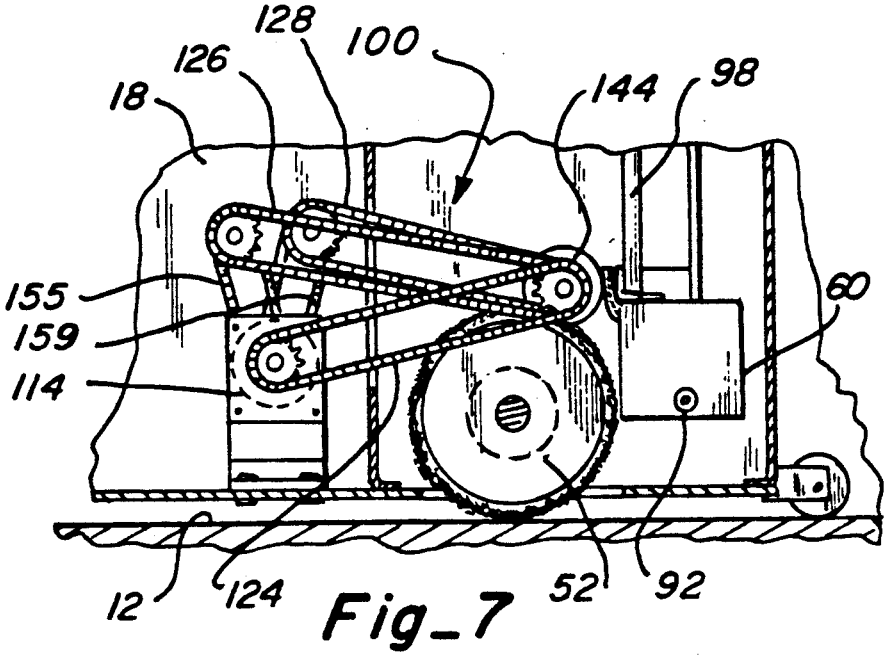
FIG. 7 is a partial vertical section, taken along line 7—7 of FIG. 6, showing three independent drive systems to the transfer roller segments.
Figure 6:
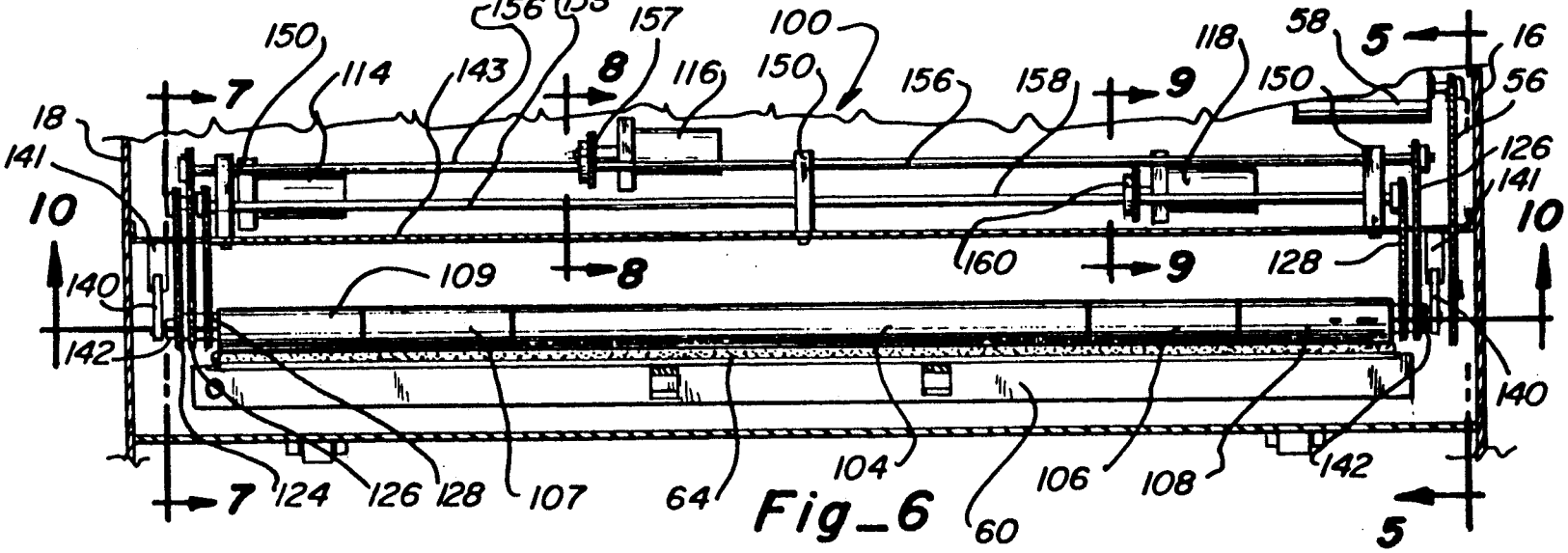
FIG. 6 is a horizontal section, taken along line 6—6 of FIG. 5, showing a system of independently driven transfer roller segments utilizing three motors to drive five segments.
Figure 9:
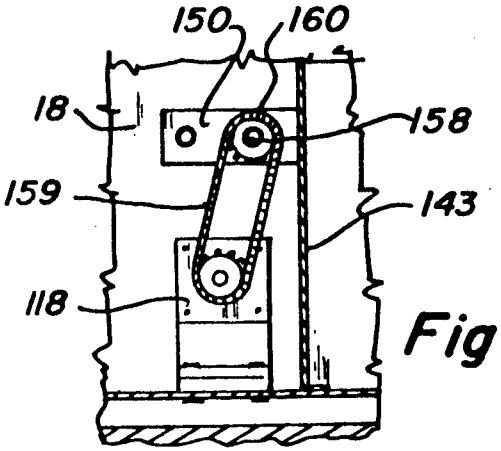
FIG. 9 is a partial vertical section, taken along line 9—9 of FIG. 6, showing the outer transfer roller segment pair motor and jack shaft.
Figure 8:
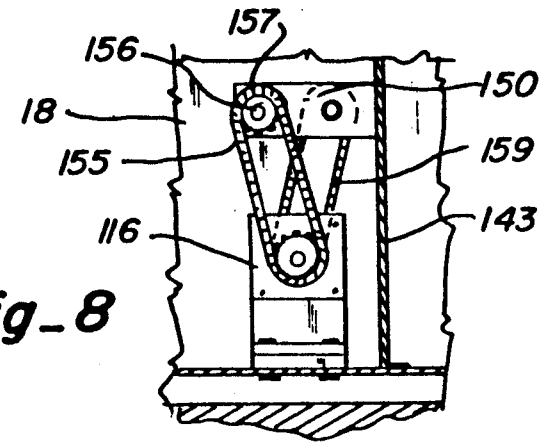
FIG. 8 is a partial vertical section, taken along line 8—8 of FIG. 6, showing two independent drive systems utilizing jack shafts to drive the outer transfer roller segment and track transfer roller segment pairs.

Apparatus 90, except for the operation of transfer system 100, operates in the same manner as apparatus 10. As in apparatus 10, tank or reservoir 60 of apparatus 90 is mounted on pivot 92 so that it may be tilted away when force is applied to it by solenoid 94, connected through link 96 to arm 98 on tank 60. Apparatus 90 differs primarily from apparatus 10, as may be seen by comparing FIG. 2 and FIG. 5, in that the single transfer roller 66 and motor 70 is replaced with transfer system 100. Transfer system 100 comprises a plurality of transfer roller segments, including a wide center roller segment 104, track roller segments 106 and 107 on opposite ends thereof, respectively, and outer roller segments 108 and 109, respectively, mounted outboard of track roller segments 106 and 107, respectively. All of the roller segments are mounted on a common axis for independent rotation. Conveniently, center roller segment 104 is driven by variable speed motor 114, track roller segments 106, 107 are driven by variable speed motor 116 and outer roller segments 108, 109 are driven by variable speed motor 118. As will be more fully described below, the roller segments are journaled at one end of arms 140 on opposite sides of carriage 14 which are pivotally mounted at their opposite ends on arm holder 141 attached to transversely extending wall 143. As best shown in FIGS. 6 and 7, center motor 114 independently drives center roller 104 directly through drive chain 124 connected to sprocket 144. Conveniently, a track roller jack shaft 156 and an outer roller jack shaft 158 extend across the carriage generally parallel to the roller axis and are journaled in spaced brackets 150 mounted on wall 143. Track jack shaft 156 is driven by track motor 116 interconnected to jack shaft drive sprocket 157 through shaft drive chain 155. Track jack shaft 156 is interconnected to track roller sprockets 146, 147 by a pair of track drive chains 126. As best shown in FIGS. 6 and 9, outer motor 118 independently drives a pair of outer rollers 108, 109. Outer jack shaft 158 is turned by outer motor 118 interconnected to shaft drive sprocket 160 through shaft drive chain 159. Outer jack shaft 158 is interconnected to outer roller sprockets 148, 149 by a pair of outer drive chains 128.

Figures 10, 11:
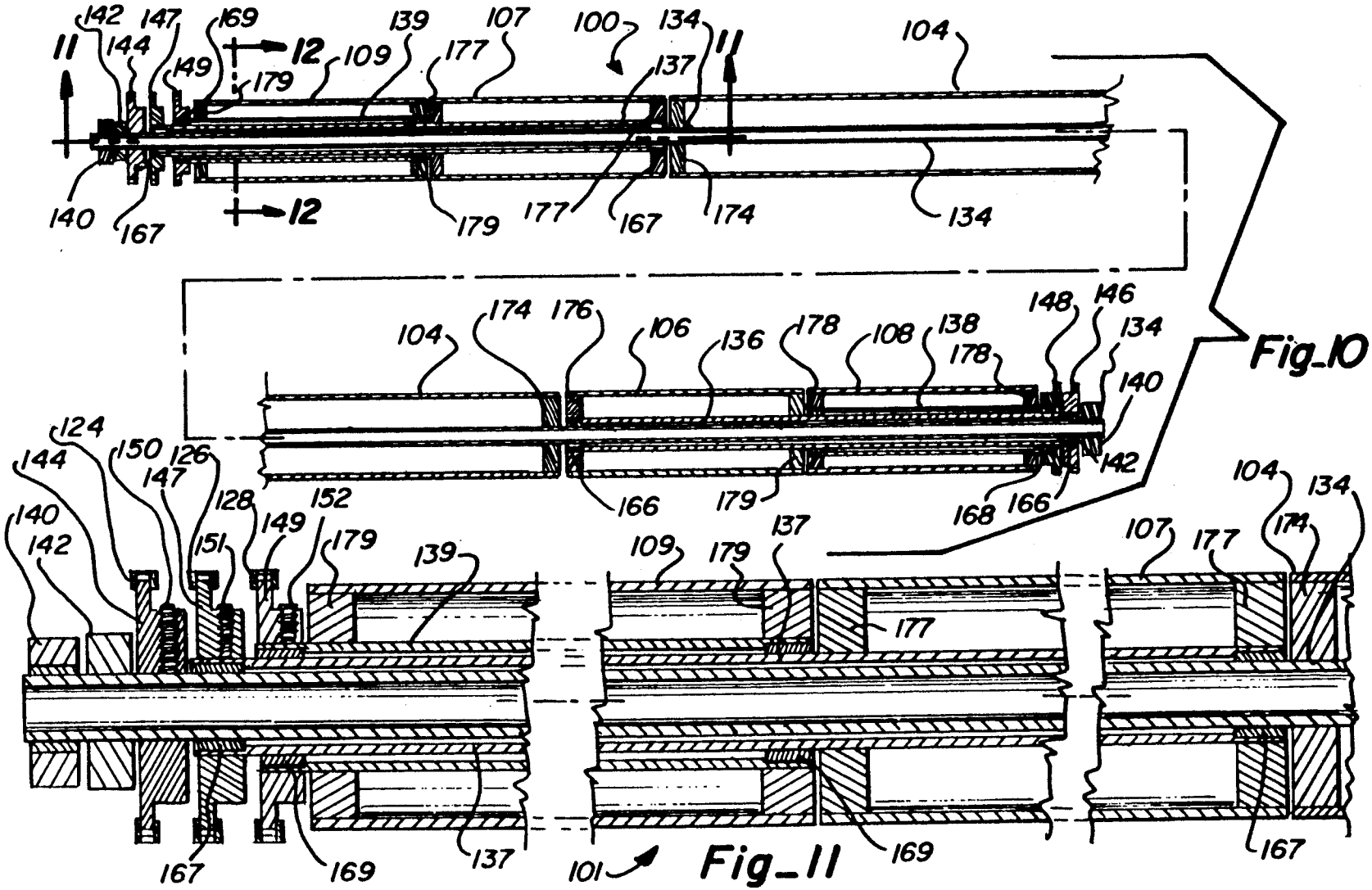
FIG. 10 is a longitudinal section, taken along line 10—10 of FIG. 6, showing a system of independently driven transfer roller segments including a center roller, a track roller pair and an outer roller pair.
FIG. 11 is an enlarged partial vertical section, taken along line 11—11 of FIG. 10, showing the concentric shafts, plugs and bushings of the transfer roller segments.
Figure 12:
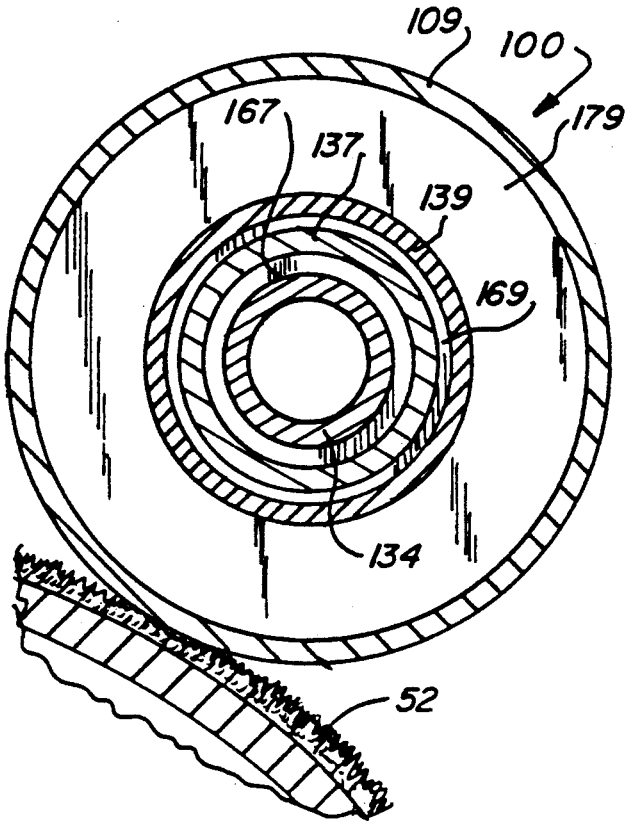
FIG. 12 is a greatly enlarged cross sectional view, taken along line 12—12 of FIG. 10, of the transfer roller element of the transfer system, showing the concentric shafts, plugs and bushings of the transfer roller segments.

FIGS. 10, 11 and 12 show in detail the mounting for the transfer roller segments. A center shaft 134 having a first diameter extends across carriage 14 and is journaled at opposite ends thereof on pivoted arms 140. A spacer 142 separates left arm 140 from center roller sprocket 144, which is connected in driving relation to center shaft 134, as by set screw 150. Center roller 104 is mounted in a fixed relationship on center shaft 134 to rotate therewith. A pair of plugs 174 terminate each side of center roller 104.

A pair of track roller shafts 137 and 138, each having a second diameter greater than the first diameter of center shaft 134, are concentrically mounted for rotation on opposite ends of center shaft 134. Left and right track rollers 107 and 106 are mounted on each track roller shaft 137 and 136, respectively, for rotation therewith. The outer end of each track roller shaft terminates inwardly adjacent to one of the opposite ends of center shaft 134. Bushings or bearings 167 and 166, respectively, are fixed inside each opposite end of track roller shafts 137 and 136 for rotation of the track roller shafts about center shaft 134. Plugs 177 and 176, respectively, are fixed inside each opposite end of left and right track rollers 107 and 106, as shown. Track sprockets 147 and 146, respectively, are connected in driving relation to track shafts 137 and 136, as by set screws 151.

A pair of outer roller shafts, 139 and 138, having a third diameter greater than the second diameter of track roller shafts 137, 136 are rotatably mounted on the outer portion of each of the track roller shafts 137, 136 respectively. Left and right outer rollers 109 and 108 are mounted on each outer roller shaft, respectively, for rotation therewith. The outer end of each outer roller shaft terminates inwardly adjacent to each of the opposite ends of track roller shaft 137, 136. Bushings or bearings 169 and 168, respectively, are fixed inside each end of each outer roller shaft 137, 136 for rotation of the outer roller shafts about the respective track roller shafts. Plugs 179 and 178, respectively, are fixed inside each end of left and right outer rollers 109 and 108. Outer sprockets 149 and 148, respectively, are connected in driving relation to outer shafts 139 and 138, as by set screws 152.

While the drawings depict a transfer roller element 100 utilizing five transfer roller segments, it is contemplated that a larger or smaller number of transfer roller elements may be used to provide the desired lane dressing profile across the lane.

Figure 13:
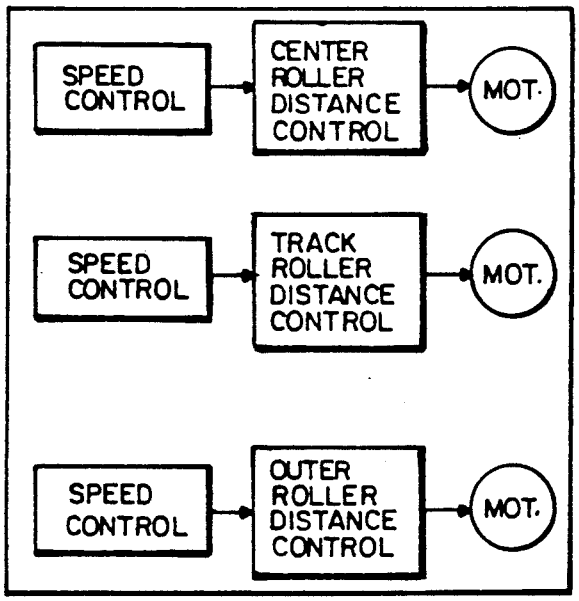
FIG. 13 is a block diagram of an apparatus fitted with three motors to drive five transfer roller segments.
Figure 14:
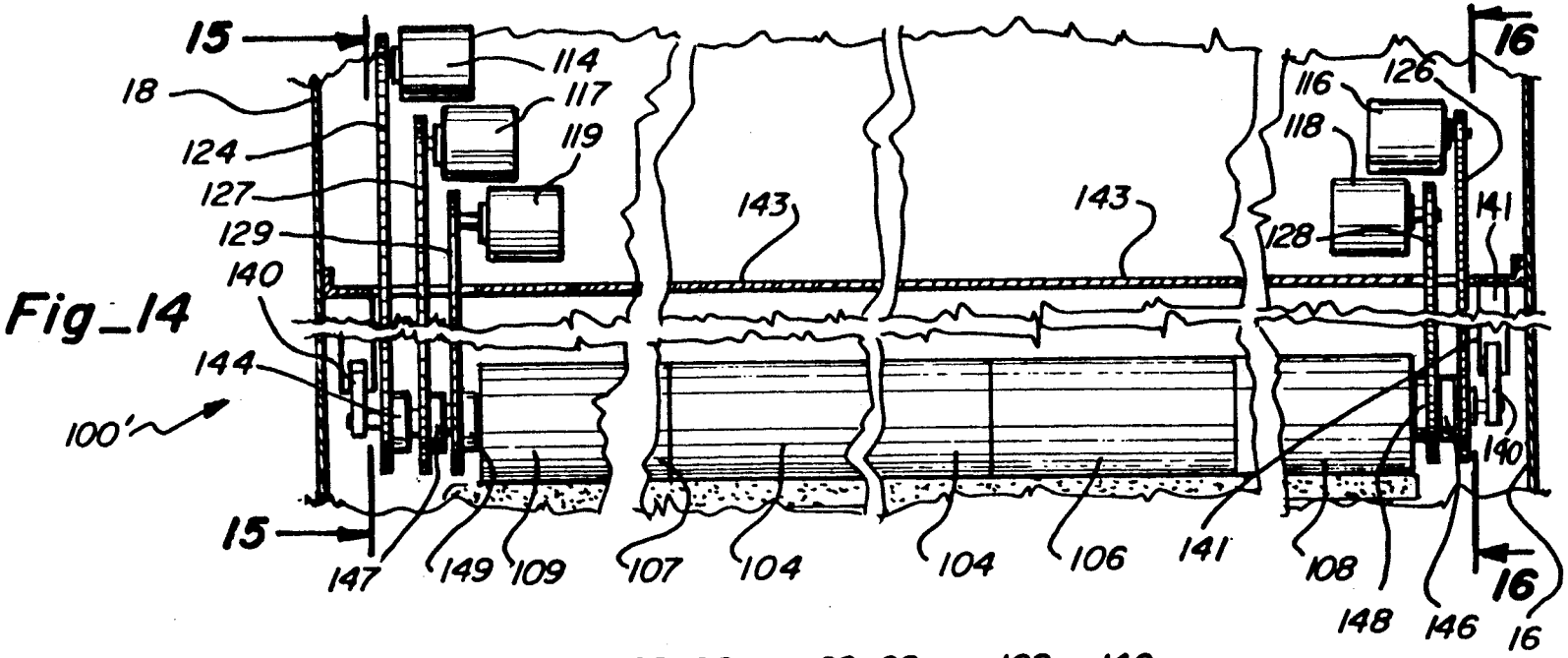
FIG. 14 is a partial horizontal section, similar to FIG. 6, but showing an apparatus fitted with a system of independently driven transfer roller segments utilizing five motors to drive five roller segments.
Figure 16:
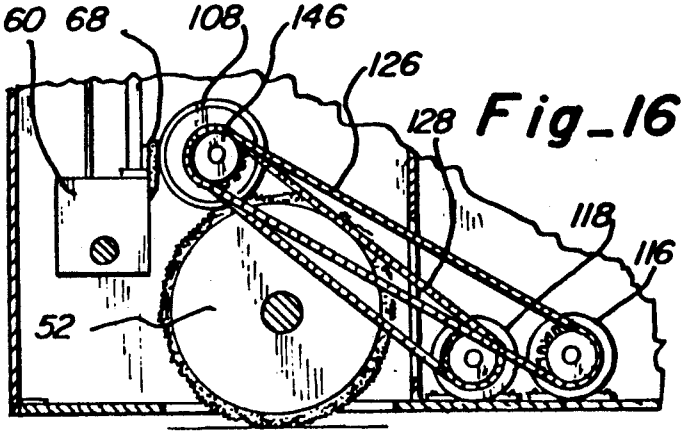
FIG. 16 is a partial vertical section, taken along line 16—16 of FIG. 14, showing two of the five motor assemblies of a five motor system.
Figure 15:
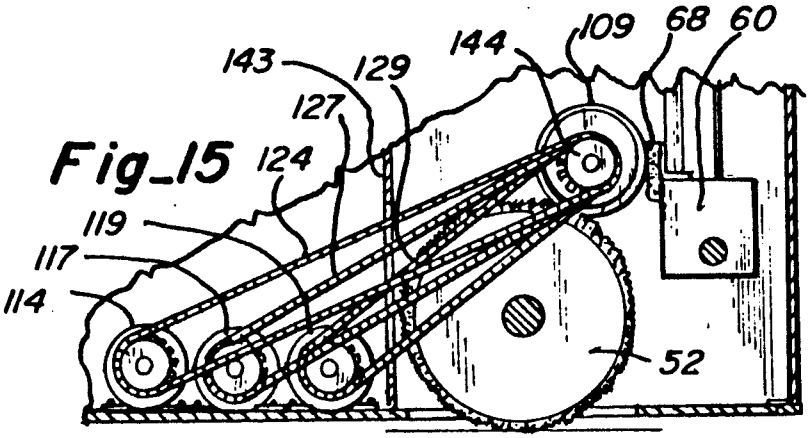
FIG. 15 is a partial vertical section, taken along line 15—15 of FIG. 14, showing three of the five motor assemblies of a five motor system.

FIG. 13 is a block diagram of the control system for a three motor transfer system 100. Each variable speed motor, 114, 116, 118, has a speed control and a lane distance control to precisely control the transfer dressing fluid 62 to a corresponding region of the buffer roller 52 and thereby precisely apply the fluid to the desired profile across lane 12. It will be understood that if the speed of any of the variable speed motors is increased a greater amount of lane dressing fluid will be transferred to the buffer roller from the transfer roller segment or segments being driven by that motor. This will increase the amount of lane dressing fluid applied to the lane over the width of that portion of the buffing roller. Similarly, if the speed of one of the variable speed motors is decreased, less lane dressing fluid will be transferred to the buffer roller and to the lane. Conveniently, the length of the roller segments can be chosen to equal a desired number of bowling lane board widths.

FIGS. 14–17 depict a further alternative transfer system 100' utilizing five motors to drive five transfer roller segments. In this arrangement, each transfer roller segment 104, 106, 107, 108, 109, is individually controlled by a separate variable speed motor 114, 116, 117, 118, 119, respectively, for complete independent control of each transfer roller segment. Center variable speed motor 114 drives center roller segment 104 through drive chain 124 connected to sprocket 144. Right track variable speed motor 116 drives right track roller 106 through drive chain 126 connected to sprocket 146. Left track variable speed motor 117 drives left track roller 107 through drive chain 127 connected to sprocket 147. Right outer variable speed motor 118 drives right outer roller 108 through drive chain 128 connected to sprocket 148. Left outer variable speed motor 119 drives left outer roller 109 through drive chain 129 connected to sprocket 149.

Figure 17:
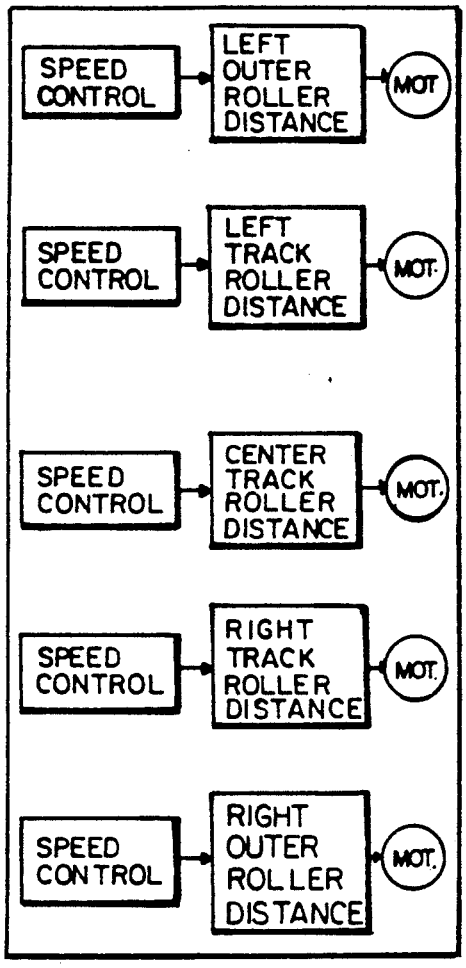
FIG. 17 is a block diagram of an apparatus fitted with five motors to drive five transfer roller segments.

FIG. 17 shows the block diagram of the control system for a five motor transfer system 100'. Each variable speed motor 114, 116, 117, 118, 119 has a speed control and alley distance control to precisely control the transfer of dressing fluid 62 to a corresponding region of the buffer roller 52 and thereby precisely apply the fluid in the desired profile across lane 12. This structure is important if it is desired to apply a different amount of dressing to one side than the other.

Although a single wick is shown, if desired the upper end of the wick can be split at the juncture of the roller segments or separate wicks could be provided for each roller to further control the profile of lane dressing fluid across the lane.

This invention has been described in detail with reference to particular embodiments thereof, but it will be understood that various other modifications can be effected within the spirit and scope of this invention.

We claim:

1. A bowling lane dressing apparatus comprising:
a carriage for movement along a bowling alley between a foul line and pit;
drive wheels rotatably mounted on said carriage in lane-contacting relation and extending transversely to the direction of travel;
a reservoir in said carriage for the storage of lane-dressing fluid;
a lane buffer roller journaled on said carriage for rotation with its surface in lane-contacting relation to transfer lane dressing fluid to the bowling alley;
a plurality of transfer rollers mounted in rolling engagement with said lane buffer roller and in fluid communication with said reservoir for transferring fluid from said reservoir to a corresponding region of said lane buffer roller; and
variable speed drive means connected to each of said transfer rollers for rotating them at variable speeds to vary the rate of transfer of fluid from said reservoir to a corresponding region of said lane buffer roller.

2. Apparatus, as claimed in claim 1, wherein said variable speed drive means comprises:
at least two variable speed motors mounted on said carriage connected to at least two different transfer rollers to rotate said two transfer rollers at different speeds relative to each other; and
a variable resistor connected to each of said variable speed motors for varying the speed of said variable speed motors independently of each other.

3. Apparatus, as claimed in claim 2, wherein:
said transfer rollers have the same outer diameter.

4. Apparatus, as claimed in claim 1, wherein said plurality of rollers are mounted on a common axis and include:
a center roller;
a pair of track rollers, one of said track rollers being mounted at each end of said center roller; and
a pair of outer rollers, one of said outer rollers being mounted at the outer end of each track roller.

5. Apparatus, as claimed in claim 4, wherein said variable speed drive means comprises:
a first variable speed drive motor connected to said center roller;
a second variable speed drive motor connected to said track rollers; and
a third variable speed drive motor connected to said outer rollers.

6. Apparatus, as claimed in claim 5, further including:
a first jack shaft interconnecting said track rollers to drive them together, said second variable speed drive motor being connected to said first jack shaft in driving engagement; and
a second jack shaft interconnecting said outer rollers to drive them together, said third variable speed drive motor being connected to said second jack shaft in driving engagement.

7. Apparatus, as claimed in claim 5, further including:
a center shaft, having a first diameter, extending across said carriage and journaled at opposite ends thereof for rotation by said first variable speed drive means and having said center roller mounted on said center shaft for rotation therewith;
a pair of track roller shafts each having a second diameter which is greater than said first diameter, each track roller shaft being rotatably mounted on opposite ends of said center shaft with one of said track rollers mounted on each of said track roller shafts for rotation therewith, each of said track roller shafts having an outer end adjacent one of said opposite ends of said center shaft; and
a pair of outer roller shafts, each having a third diameter which is greater than said second diameter, each outer roller shaft being rotatably mounted on one of said track roller shafts with one of said outer rollers mounted on each of said outer roller shafts for rotation therewith, each of said outer roller shafts having an outer end adjacent one of said outer ends of said track roller shaft.

8. Apparatus, as claimed in claim 7, further including:
a first sprocket means connected in driving relation to one end of said center shaft;
first means connecting said first sprocket means to said first variable speed drive motor;
a second sprocket means including a pair of sprockets, one of which is connected to said outer end of each of said pair of track roller shafts;
second means connecting said second sprocket means to said second variable speed drive motor;
a third sprocket means including a pair of sprockets, one of which is connected to said outer end of each of said pair of outer roller shafts; and
third means connecting said third sprocket means to said third variable speed drive motor.

9. Apparatus, as claimed in claim 8, wherein:
said first connecting means includes a first drive chain means having a first drive chain interconnecting said first variable speed drive motor and said first sprocket;
said second connecting means includes a track roller jack shaft extending parallel to said common axis, rotatably mounted within said carriage, and having opposite ends, second drive chain means having a pair of drive chains, each interconnecting one end of said track roller jack shaft with one of said second pair of sprockets, and means interconnecting said track roller jack shaft in driving relationship to said second variable speed drive motor; and
said third connecting means includes an outer roller jack shaft extending parallel to said common axis, rotatably mounted within said carriage, and having opposite ends, and third drive chain means having a pair of drive chains, each interconnecting one end of said outer roller jack shaft with one of said third pair of sprockets, and means interconnecting said outer roller jack shaft in driving relationship to said third variable speed drive motor.

10. Apparatus, as claimed in claim 4, wherein said variable speed drive means comprises:
separate variable speed drive motors connected to said center roller, each of said pair of track rollers and each of said pair of outer rollers, respectively.

11. A bowling lane dressing apparatus comprising:
a carriage for movement along a bowling alley between a foul line and pit;
drive wheels rotatably mounted on said carriage in lane-contacting relation and extending transversely to the direction of travel;
a reservoir in said carriage for the storage of lane-dressing fluid;
a lane buffer roller journaled on said carriage for rotation with its surface in lane-contacting relation to transfer lane dressing fluid to the bowling alley;
a plurality of transfer rollers mounted on a common axis in rolling engagement with said lane buffer roller and in fluid communication with said reservoir for transferring fluid from said reservoir to a corresponding region of said lane buffer roller;

a first drive means connected to said drive wheels for rotating the same to move said carriage along the bowling alley;

a second drive means for rotating said lane buffer roller; and variable speed drive means connected to each of said transfer rollers for rotating them at variable speeds to vary the rate of transfer of fluid from said reservoir to a corresponding region of said lane buffer roller.

12. Apparatus, as claimed in claim 11, wherein said variable speed drive means comprises:

at least two variable speed motors mounted on said carriage connected to at least two different transfer rollers to rotate said two transfer rollers at different speeds relative to each other; and a variable resistor connected to each of said variable speed motors for varying the speed of said variable speed motors independently of each other.

13. Apparatus, as claimed in claim 12, wherein:

said transfer rollers having the same outer diameter.

14. A bowling lane dressing apparatus comprising:

a carriage for movement along a bowling alley between the foul line and pit;

drive wheels rotatably mounted on said carriage in lane-contacting relation with the alley;

a reservoir in said carriage for the storage of a lane dressing fluid;

a lane buffer roller journaled for rotation on said carriage with its surface in lane-contacting relation with the bowling alley to apply lane dressing fluid to the alley;

a transfer system of independent roller segments comprising a plurality of roller segments of the same outer diameter, driven by independent variable speed drive means such that each roller or any rolling pair can be driven at a specified individual speed, said transfer system being in rolling engagement with said lane buffer roller and in fluid communication with said reservoir for transferring fluid from said reservoir to the corresponding region on said lane buffer roller.

15. A bowling lane dressing apparatus as claimed in claim 14 wherein:

each transfer roller segment outwardly adjacent to a previous roller segment is mounted for rotation with a shaft of greater inner diameter than the outer diameter of the next inner roller segment shaft, and has a length less than that of the next inner shaft, means interconnecting each of said outwardly adjacent transfer roller drive means to one of said independent variable speed drive means; and the innermost roller segment shaft is journaled at opposite ends.

16. A bowling lane dressing apparatus as claimed in claim 14 wherein said transfer system of independent rollers comprises:

five roller segments consisting of a center roller segment, right and left track roller segments and right and left outer roller segments;

a center shaft extending from both ends of said center roller segment, journaled on each outer end, and engaged in driving relationship by a variable speed drive means on one of said ends;

a pair of track shafts of greater inner diameter than the outer diameter of said center shaft mounted for rotation thereon, extending longitudinally outward from each of said track roller segments for a distance shorter than said ends of said center shaft and engaged in driving relationship by a variable speed drive means at each end; and outer shafts of greater inner diameter than the outer diameter of said track shafts mounted for rotation thereon, extending longitudinally outward from each of said outer roller segments for a distance shorter than said ends of said track shaft and engaged in driving relationship by a variable speed drive means at each end.

17. A bowling lane dressing apparatus as claimed in claim 16 wherein:

said track roller variable speed drive means includes a track roller jack shaft which engages each track roller shafts in driving engagement; and said outer variable speed drive means includes an outer roller jack shaft which engages each outer roller shaft in driving engagement.

* * * * *